United States Patent [19]

Tokumoto et al.

[11] 4,113,582

[45] Sep. 12, 1978

[54] METHOD OF ADJUSTING A FUSED SALT ELECTROLYTIC BATH

[75] Inventors: Shin-ichi Tokumoto; Eiji Tanaka, both of Yokohama; Tatsuo Kikuchi, Hoya; Kenji Ogisu, Yokohama; Toshiro Tsumori, Tokyo, all of Japan

[73] Assignee: Sony Corporation, Tokyo, Japan

[21] Appl. No.: 802,487

[22] Filed: Jun. 1, 1977

[30] Foreign Application Priority Data

Jun. 4, 1976 [JP] Japan ..... 51-65921

[51] Int. Cl.[2] ..... C25D 3/66

[52] U.S. Cl. ..... 204/39

[58] Field of Search ..... 204/39, 64 T

[56] References Cited

U.S. PATENT DOCUMENTS

| | | | |
|---|---|---|---|
| 3,024,174 | 3/1962 | Stetson | 204/39 |
| 4,016,052 | 4/1977 | Tokumoto et al. | 204/39 |

*Primary Examiner*—John H. Mack
*Assistant Examiner*—William Leader
*Attorney, Agent, or Firm*—Hill, Gross, Simpson, Van Santen, Steadman, Chiara & Simpson

[57] ABSTRACT

A high valency salt, such as $TiCl_4$ is reduced to a lower valency salt, such as $TiCl_2$ and/or $TiCl_3$ within a fused salt electrolytic bath via electrolysis so that an improved electrodeposition of a desired metal or alloy, such as Ti, occurs, from such adjusted bath. The process generally comprises adding a higher valency salt of a desired metal or alloy to a fused salt electrolytic bath, reducing the higher valency salt on a cathode electrode to a lower valency salt, removing the so-produced lower valency salt from the electrode surface and maintaining a predetermined amount of the lower valency salt within the electrolytic bath. Electrodeposition of a desired metal or alloy may then take place from such electrolytic bath containing a so-adjusted amount of the lower valency salt.

12 Claims, 3 Drawing Figures

Fig. 1
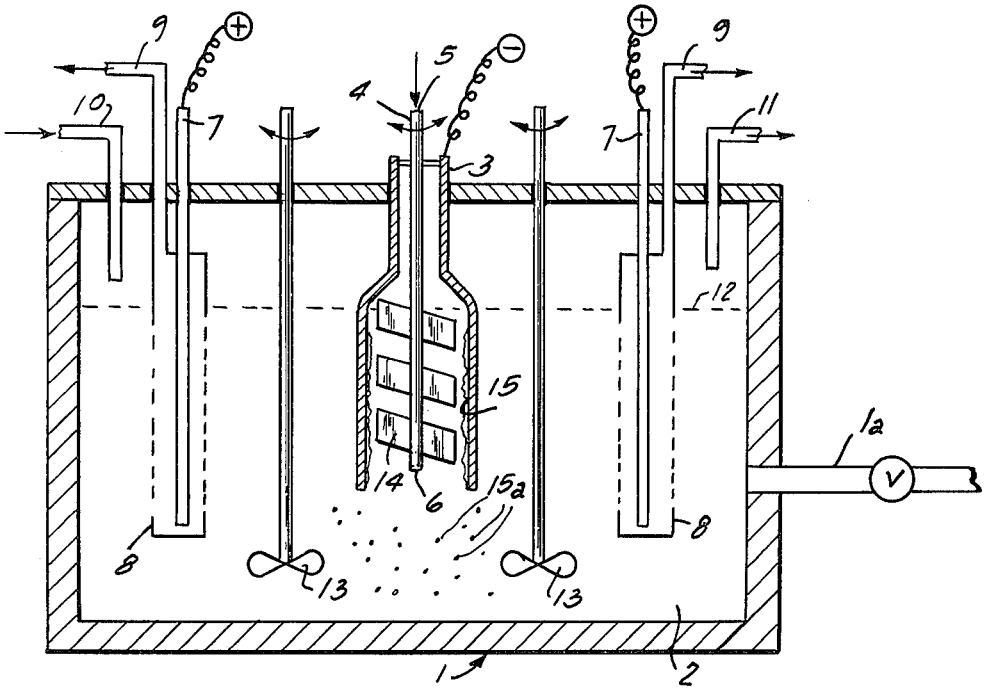
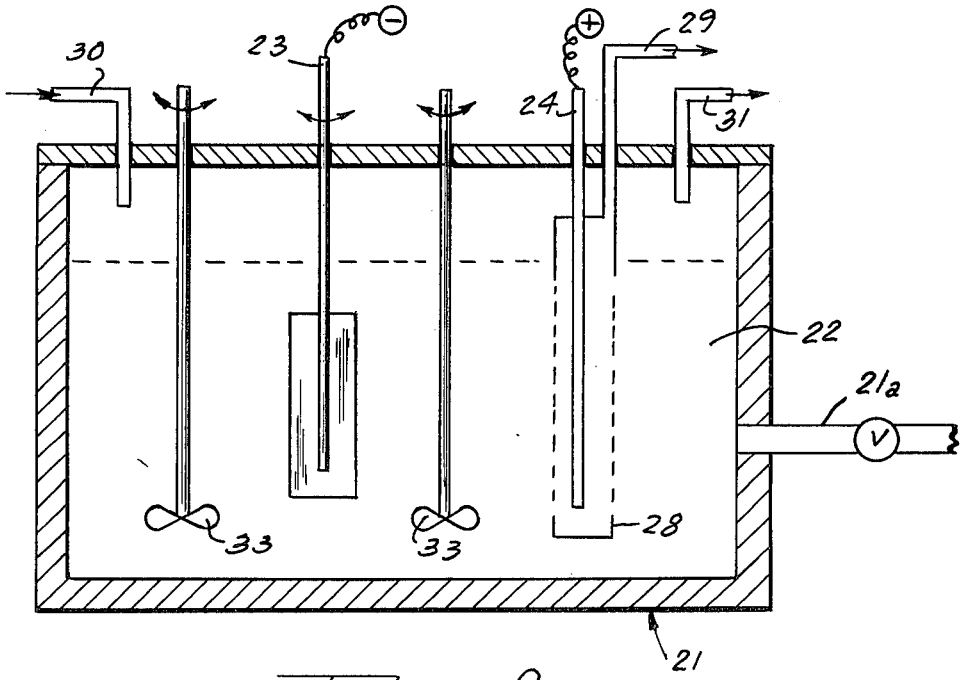
Fig. 2

METHOD OF ADJUSTING A FUSED SALT ELECTROLYTIC BATH

BACKGROUND OF THE INVENTION

1. Field of the Invention

The invention relates to an electrodeposition process and somewhat more particularly to an electrolytic process involving the use of a fused salt electrolyte.

2. Prior Art

When a desired metal or alloy, such as titanium, is electrodeposited by prior art fused salt electrolytic methods, the deposited metal or alloy thereof is generally obtained only in a fused state or as a powder, granulated crystals, dendrite or sponge. Accordingly, we have proposed various electrodeposition processes in which a novel fused salt electrolytic bath is used so that an electrodeposited material or alloy can be obtained in a desired shape, such as a flat plate, a compact ingot, a cake or the like having a desired thickness which can be readily processed, such as by rolling or forming operations without requiring remelting, etc. (J. of Metals, Vol. 27, No. 11, November 1975, pp. 18–23). In addition, we have proposed electrodeposition process, such as disclosed in Japanese Patent Application Nos. 131970/1974, which corresponds to U.S. Pat. No. 4,016,052 and 107500/1974, which corresponds to U.S. Pat. No. 4,049,507, as well as in Japanese Pat. No. 726754, which corresponds to U.S. Pat. No. 3,662,047.

In the above described electrolysis methods, the composition of the fused salts in a fused salt electrolytic bath is important. However, it is also important to increase the concentration of a raw-material component salt of a desired metal or alloy to be electrodeposited, preferably at least around the electrodeposition surface, i.e., the cathode surface.

In order to electrodeposit a desired metal or allow, for example, titanium, from a fused chloride salt electrolytic bath so that the deposited metal surface is maintained relatively homogeneous, smooth and flat, theory suggests that it may be advisable to maintain a lower valency salt, for example, of titanium (i.e., $TiCl_2$ and/or $TiCl_3$) at a concentration in the vicinity of the cathode greater than the solubility of such lower valency salt in the electrolytic bath at the electrolytic temperature.

However, the above theoretical suggestion is of no particular importance in the prior art processes since the primary object thereof was merely to produce an electrodeposited metal as granulated crystals, powders or as a sponge. Nevertheless, in order to achieve an electrodeposition process in which a desired metal, for example, titanium, is electrodeposited from a fused chloride salt electrolytic bath as a deposit which has substantially homogeneous smooth flat surfaces, it appears necessary to increase the concentration of a lower valency salt of a desired metal contained within a fused electrolytic bath, as compared with presently known fused salt electrolytic baths but no process for adjusting the concentration of certain components within such a bath is presently known.

SUMMARY OF THE INVENTION

It is a main object of the invention to provide a method of adjusting the concentration of certain components within a fused salt electrolytic bath.

In accordance with the principles of the invention, the main object of the invention is attained by preparing a fused salt electrolytic bath which includes an anode and a cathode therein for a reduction reaction, adding a high valency salt of a desired metal or alloy (i.e., salts of the constituent metals of the alloy) to such bath, energizing the bath so as to reduce the high valency salt to a lower valency salt on the cathode surface, removing the lower valency salt from the cathode surface and maintaining a predetermined amount of such lower valency salt in the original electrolytic bath. Of course, the reduction reaction may take place within one electrolytic cell or segregated cell region and a select amount of the electrolyte containing a desired amount of the lower valency salt be transferred to another electrolytic cell or cell region for electrodeposition of a desired metal or alloy.

It is another object of the invention to adjust a fused salt electrolytic bath so that an enhanced electrodeposition can be attained via the fused salt electrolysis method, in such a manner that the surface of the electrodeposited metal or alloy is maintained substantially homogeneous, smooth and flat.

It is another object of the invention to produce a lower valency salt of a desired metal or alloy from the higher valency salt thereof by means of electrolytic reduction in a fused salt electrolytic bath.

It is yet a further object of the invention to maintain the amount or concentration of a lower valency salt of a desired metal or alloy in the vicinity of an electrodeposition surface within an electrolytic bath higher than the solubility of such lower valency salt within the electrolytic bath at the electrolytic temperature so as to achieve an enhanced electrodeposition of the desired metal or alloy.

Other objects, features and advantages of this invention will become more apparent from the following description, taken in conjunction with the accompanying drawings.

BRIEF DESCRIPTION OF THE DRAWINGS

FIG. 1 is a somewhat schematic cross-sectional view showing an embodiment of a raw-material adjusting electrolytic cell useful in the practice of a process in accordance with the principles of the invention;

FIG. 2 is a somewhat schematic cross-sectional view of an embodiment of a main electrolytic cell useful for electrodepositing a metal or alloy in the practice of a process in accordance with the principles of the invention.

DESCRIPTION OF THE PREFERRED EMBODIMENTS

Figure 3:
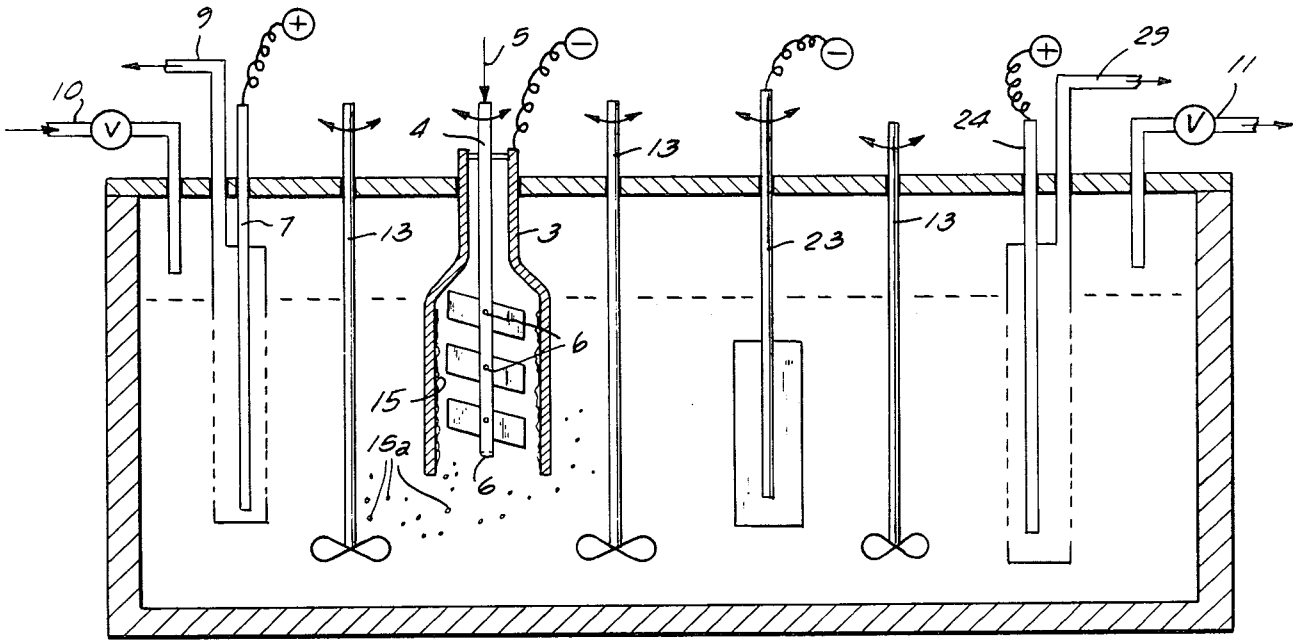
FIG. 3 is a somewhat similar view as FIGS. 1 and 2, showing an embodiment of an electrolytic cell useful in the practice of the invention.

In accordance with the principles of the invention, the method of adjusting a component within a fused salt electrolytic bath comprises adding an available higher valency salt of a desired metal or alloy to an operational fused salt electrolytic bath, reducing such higher valency salt of the desired metal or alloy to a lower valency salt thereof on an electrodeposition or reduction surface within such bath and removing the so-produced low valency salt from the electrodeposition surface.

In order to proceed in accordance with the principles of the invention, a suitable electrolytic electrode is provided within a fused salt electrolytic bath for producing a lower valency salt of a desired metal or alloy from a higher valency salt thereof by means of electrolytic reduction. A further electrolytic electrode for electrodepositing the desired metal or alloy from the electrolytic bath containing the lower valency salt therein may also be provided. Both of these electrodes may be provided with a single electrolytic cell or in different cells which are operationally coupled or in fluid communication with one another by a proper means. It is also within the scope of the invention to provide a single electrode within a single electrolytic cell for performing both of the above operations, i.e., valence reduction and electrodeposition of a desired metal or alloy.

In the following description, the portions of an electrolytic cell or cells wherein the respective electrodes are provided will be referred to as raw-material adjusting electrolytic sections and as metal depositing electrolytic sections, respectively.

As indicated, an available higher valency salt of a desired metal or alloy, such as $TiCl_4$ (which is readily available in gaseous form) is introduced into the raw-material adjusting electrolytic section containing a fused salt electrolytic bath, which generally may be comprised of alkali and alkaline earth metal halogenides, particularly chloride, salts, The higher valency salt may be added to such an electrolytic bath in whatever form such salt is available, however, a gaseous form is preferred and if a select high valency salt is not available as a gas, it may be converted to such by heating as the occasion demands. Further, a higher valency salt may be introduced independently or with a carrier into an electrolytic bath. For example, when a gaseous higher valency salt is introduced into an electrolytic bath, it may be admixed with a carrier gas, such as argon. The so-introduced higher valency salt is dispersed within the electrolyte or dissolves within the electrolytic bath without reaction. Then an electrolytic reduction reaction is carried out by the electrolytic electrode so as to obtain a lower valency salt. It is preferable to carry out the reduction reaction at a temperature equal to or greater than the main metal depositing electrolytic temperature.

The higher valency salt may be supplied onto the surface of an electrolytic bath or be supplied directly within the electrolytic bath of the raw-material adjusting electrolytic section. However, when the higher valency salt is supplied to the bath surface, a crust may be formed on the bath surface and such crust must be broken-up as the occasion demands. On the other hand, when the high valency salt is supplied directly into the electrolytic bath, the supply port outlet must be kept open since generated reduction products or cooled or solidified electrolytic components tend to block such outlets so that it may be necessary to remove such solidification products from the outlet port by a suitable means, for example, a brush.

In order to perform the electrolytic reduction process in accordance with the principles of the invention in a smooth and continuous fashion, it is desirable and/or necessary, to remove, as by a mechanical means, the reduced salt material from the electrodeposition surface. Alternatively, when solid particles of such reduced salt materials form, as during super-saturation, one may sufficiently agitate the resulting electrolytic bath so that such particles collide against the electrodeposition surface and the reduced salt material to remove the same from such surface and disperse and/or dissolve the reduced materials within the electrolytic bath.

The so-produced and adjusted electrolytic bath may be cooled, if desired or necessary, and transferred to the metal-depositing electrolytic section. The lower valency salt of a desired metal or alloy can be readily supplied to the metal-depositing electrolytic section at a concentration of such lower valency salt close to the saturation point thereof within the electrolytic bath at the electrolytic temperature and any excess lower valency salt may be simply dispersed within such electrolytic bath as solid particles. That is, accordingly to the principles of the invention, the electrolytic bath within the metal-depositing electrolytic section is provided with a high concentration of a lower valency salt of a desired metal or alloy, which is at least close to the saturation concentration of such salt within the electrolytic bath at the electrolytic temperature.

In the following description of exemplary embodiments of apparatus useful in the practice of the invention, the invention will be described for adjusting the concentration of $TiCl_2$ and $TiCl_3$ within a fused salt electrolytic bath by electrolytic reduction of $TiCl_4$ so as to provide a titanium or titanium alloy-depositing bath having a desired average valency state of titanium salts therein for enhanced electrodeposition of metal therefrom so that the so-deposited metal has surfaces which are homogeneous, smooth and flat. It will, of course, be understood that other metals and alloys may similarly be produced. Exemplary metals and alloys which can be utilized in the practice of the invention include Mn, Ti, V, Ti—Fe, Ti—Mn, Ti—Al, etc.

FIG. 1 illustrates a raw-material adjusting electrolytic cell 1 containing a suitable fused salt electrolytic bath or electrolyte so that a given volume thereof is provided within the cell 1 to define a bath surface 12. A somewhat bell-shaped cathode 3 is positioned within the cell so as to have a surface, i.e., an electrodeposition or reduction surface, immersed within the bath. The cathode 3 is, of course, operationally coupled to a controlled electrical energy source. A hollow supply pipe 4 or the like is provided in the vicinity of the cathode 3 for introducing a higher salt, i.e., $TiCl_4$ per se or as an admixture with argon gas. The supply pipe may be positioned within the cathode as shown and includes an inlet 5 in communication with a suitable source of such higher valency salt (not shown) and an outlet 6, which is positioned below the surface 12 of the electrolytic bath. If desired, a plurality of outlets may be provided within the pipe 4 to aid in the dispersion of the supplied higher valency salt within the electrolyte. A pair of anodes 7 are provided within the electrolytic cell 1 on either side of the cathode 3 and are each operationally connected to a controlled electrical energy source. Each anode is surrounded by a diaphragm 8 which communicates with a gas outlet 9 for venting any generated gas, such as chlorine, from within the cell 1. A controlled gas inlet 10 is provided within the electrolytic cell 1 so as to allow the ingress of a protective gas, such as argon, into the cell 1 and a controlled gas outlet 11 is likewise provided for selective venting of such protective gas. Agitation means, such as propellers 13, driven by a suitable drive means (not shown) are provided within the electrolytic bath for agitating the same as desired. As shown, the pipe 4 is provided with a plurality of vanes 14 attached to the outer surface of the pipe 4, which is mounted for rotation, as schematically indicated by the double-headed arrow. Upon energization, the reduced material 15 concentrates either as ions within the enclosed cathode space or forms as solid particles on the electrodeposition or reduction surface of the cathode, i.e., the inner surface thereof, and by controlled rotation of the pipe 4, the vanes 14 remove, as by scraping, the reduced material from the region of the electrodeposition or reduction surface and distribute such reduced material 15a within the electrolytic bath 2. The cell 1 may be provided with a controlled fluid communication means 1a for selective withdrawal of the electrolyte when a desired concentration of a lower valency salt is attained therein.

FIG. 2 illustrates an exemplary metal-depositing electrolytic cell 21 in which a desired metal or alloy may be deposited from an electrolytic bath prepared, for example, in the raw-material adjusting electrolytic cell 1 described at FIG. 1. The cell 21 is substantially air-tight and contains an electrolytic bath or electrolyte 22 which contains a substantially high concentration of a lower valency salt of a desired metal or alloy being deposited. An electrodeposition surface, such as a rotating cathode 23, is provided within the cell and operationally coupled to a suitably controlled electrical energy source. The rotating cathode 23 is coupled to a suitable drive means for rotating the same at a select rate. The desired metal or alloy deposits on the immersed surface of such cathode as a substantially homogeneous, smooth and flat deposit. An anode 24 is provided within the cell spaced from the cathode 23 and is likewise operationally coupled to a controlled electrical energy source. A gas outlet 29 is provided in communication with a diaphragm 28 surrounding the anode 24 for venting any generated gases, such as chlorine, during the electrolysis process. Gas inlets and outlets 30 and 31, respectively, are also provided for a protective gas, such argon. Suitable agitation means, such as propellers 33, are also provided for maintaining a predetermined flow of electrolyte past the electrodeposition surface. The smooth electrodeposition of a metal or an alloy from the electrolytic cell 21 is performed in a well known manner. Briefly, cathode 23 is rotated at a predetermined rate and the electrodeposition reaction is continuously carried out while a predetermined relation is maintained between the surface of cathode 23 and the electrolyte 22. Further details of the operation of such process may, for example, be obtained from our earlier referenced publications.

In the exemplary embodiments shown at FIGS. 1 and 2, the raw-material adjusting electrolytic cell 1 and the main electrolytic cell 21 are shown as being separate, however, an integrated electrolytic cell such as shown at FIG. 3 may be utilized wherein an auxiliary cathode and a main cathode are positioned in spaced-apart relation together within a single cell. It will, of course, be understood that electrolytic cells of configurations other than that above the described may also be used in the practice of the invention.

With the foregoing general discussion in mind, there is presented detailed examples, using titanium as a desired metal, which will illustrate to those skilled in the art the manner in which the invention is carried out. However, the examples are not to be construed as limiting the scope of the invention in any way.

EXAMPLE I

In an apparatus of the type described in conjunction with FIG. 1, an examplary fused salt electrolyte bath was adjusted to contain $Ti^{+2}$ and $Ti^{+3}$ in a manner described below and titanium metal was then electrodeposited from such adjusted electrolyte bath.

Alkali and alkaline earth metal chloride salts, without any titanium salts therein, were prepared as an electrolyte bath by adding a select amount of such salts to the cell and heating the cell to a temperature of about 560° C. under an argon atmosphere. The composition of the electrolytic bath (in mole fractions) was as follows:

$BaCl_2$: 24.3
$MgCl_2$: 23.6
$CaCl_2$: 14.1
NaCl: 41.0
KCl: 19.7

The above electrolytic bath, while being heated and under the protective argon atmosphere, was agitated and then supplied with $TiCl_4$ below the surface thereof in the vicinity of the cathode (which had a structure similar to cathode 3 in FIG. 1). The electrodes within the cell were then energized and a cathode scraper (similar to vanes 14 in FIG. 1) was rotated so as to scrape against the electrodeposition surface on the cathode and the electrolytic reduction was carried out under the following parameters:

Supply rate of $TiCl_4$: 44 ml/hr.
Rotation rate of cathode scraper: 100 rpm.
Electrolytic temperature: 540° C.
Current type and density: interrupted DC 11.7A $dm^{-2}$, energized for 9 sec. and cut off for 1 sec.
Time of electrolytic reaction: 12 hrs.

After denergization, the resulting fused salt bath was analyzed and found to contain $Ti^{+2}$ and $Ti^{+3}$ therein, with an average valency of 2.12. It was calculated that the current efficiency was about 95%.

The above described fused salt electrolytic bath containing $Ti^{+2}$ and $Ti^{+3}$ dispersed therein was then placed in a metal electrodeposition cell, such as described in conjunction with FIG. 2 and this cell was then suitably energized to electrodeposit a smooth, glossy titanium deposit on an electrodeposition surface similar to that described in FIG. 2.

EXAMPLE II

In the previous Example, $TiCl_4$ was introduced into a fused salt electrolytic bath at a time when no titanium salts were present in such bath so as to produce lower valency titanium salts therein. In the present Example, $TiCl_4$ was introduced into a fused salt electrolytic bath which already contained a small amount of $TiCl_2$ and $TiCl_3$ so as to increase the concentration of these lower valency salts of titanium in the electrolytic bath. The original (prior to electrolytic reduction) fused salt electrolyte had the following composition (in mole fractions):

$BaCl_2$: 24.3
$MgCl_2$: 23.6
$CaCl_2$: 14.1
MaCl: 41.0
KCl: 19.7
$TiCl_2$: 10.0
$TiCl_3$: 1.4 and this electrolyte was suitably heated and agitated under a protective atmosphere as earlier described and an addition of $TiCl_4$ was made in the vicinity of the cathode. The electrodes within the cell and the cathode scraper were then energized and an electrolytic reduction was carried out under the following parameters:

Supply rate of $TiCl_4$: 183 ml/hr.
Rotation rate of cathode scraper: 200 rpm
Electrolytic temperature: 550° C.

Current type and density: interrupted DC 50A $dm^{-2}$ energized for 9 sec. and cut off for 1 sec.

After deenergization, the resulting electrolyte was analyzed in detail and the composition thereof was as follows (in mole fractions):

$BaCl_2$: 24.3
$MgCl_2$: 23.7
$CaCl_2$: 14.0
NaCl: 41.0
KCl: 19.6
$TiCl_2$: 26.0
$TiCl_3$: 3.5

As is apparent from the above analysis, the electrolytic bath composition after reduction contained an almost identical mole ratio between $TiCl_2$ and $TiCl_3$ as before reduction but at an increased amount and with an average valency of 2.12. The current efficiency was calculated to be about 93.5%.

The above described fused salt electrolyte (after reduction) was then placed in a metal electrodeposition cell such as described in conjunction with FIG. 2 and a glossy, smooth titanium deposit was obtained therefrom via electrolysis.

As may be apparent from the foregoing examples, $TiCl_4$ is less soluble in a fused electrolytic bath when such bath does not originally contain lower valency titanium salts. However, when, for example, titanium dichloride is present in a fused salt electrolytic bath, the amount of $TiCl_4$ added thereto can be materially increased (i.e., at least quadrupled relative to the amount which can be added to such a bath without $TiCl_2$ therein). It is theorized that this phenomena is caused by the fact that the amount of $TiCl_4$ dissolved within a bath per hour is increased by the following reaction:

$$TiCl_2 + TiCl_4 \rightarrow 2\ TiCl_3$$

In other words, titanium dichloride may react with titanium tetrachloride to produce titanium trichloride so that a larger amount of titanium tetrachloride can be added to a bath already containing at least titanium dichloride therein. Of course, the titanium trichloride is reduced via electrolysis to titanium dichloride so that the above reaction is more or less continuous. Further, when titanium metal is included within a fused salt electrolytic bath, a reduction reaction somewhat similar to that above described occurs, as shown by the following equations:

$$3Ti^{+4} + Ti \rightarrow 4Ti^{+3}$$

or $$Ti^{+4} + Ti \rightarrow 2Ti^{+2}$$

Since the solubility of titanium trichloride in a fused salt electrolytic bath is quite high relative to titanium tetrachloride, the amount of titanium tetrachloride added per hour within a bath containing titanium metal can be materially increased so that the electrolytic (reducing) current density can also be increased for more efficient operation. The amount of titanium tetrachloride added per unit time to a fused salt electrolytic bath and the reducing current density utilized with such bath may thus be increased as described above.

However, in addition to the foregoing factors, the utilized current density and the rate of $TiCl_4$ addition is also effected by the composition of the fused salt electrolytic bath, the agitation or flow pattern within such electrolytic bath, the electrolytic temperature, the rate of removal of the reduced ions or cyrstal from the reduction surface (i.e., inner walls of cathode 3), the interrupting period and interrupting ratio of the electrolytic current utilized and other like factors.

Nevertheless, the removal rate of the reduction products from the cathode surface, as by scraper means 14, is a controlling parameter because as crystals or the like of lower valency titanium salts are deposited on the electrolytic cathode, they tend to insulate the cathode surface from the electrolytic bath and the removal of such lower valency titanium salts prevents the electrolytic current from being cut off and produces saturation or near saturation of the lower valency salts within the bath at the electrolytic temperatures. As a result, a high concentration of lower valency titanium salts, for example, titanium dichloride, can continuously be produced within the electrolytic bath over a prolonged time period.

As stated earlier, a high concentration of $TiCl_2$ and $TiCl_3$ are necessary for electrodeposition of a substantially homogeneous, smooth and flat deposit of titanium metal. The process of the invention allows one to easily adjust the abundance ratio of $TiCl_2$ and $TiCl_3$ (described in fuller detail in commonly assigned U.S. Pat. No. 3,662,047, which is incorporated herein by reference), or the average valency state thereof within an electrolytic bath as desired.

In the above described exemplary embodiments, the raw-material adjusting electrolytic section for reducing a higher valency salt to a lower valency salt and the metal deposition electrolytic section are described as being provided within separate electrolytic cells. However, such sections may, of course, be disposed in operational relation with a single cell.

Further, in the above Examples, only titanium tetrachloride was added to the fused salt electrolytic baths. However, titanium tetrachloride may also be controllably added to such electrolytic baths via a carrier gas, such as argon. In addition, while only titanium was electrodeposited from an adjusted electrolytic bath, it will be appreciated that titanium alloys, such as Ti—Fe, Ti—Al, Ti—Mn, etc. can also be so-electrodeposited as flat, substantially homogeneous smooth deposits.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. An electrodeposition process comprising the steps of:

(a) preparing a fused salt electrolytic bath containing at least alkali and alkaline earth metal chloride salts therein;

(b) providing at least operational first and second cathode electrodes and at least one operational anode electrode within said bath;

(c) adding a higher valency salt of a metal to be deposited from said bath or higher valency salts of constituent metals of an alloy to be deposited from said bath to said bath;

(d) reducing said higher valency salt into a lower valency salt on said first cathode;

(e) removing said lower valency salt from said first cathode and dispersing said lower valency salt within said bath; and (f) electrodepositing the metal or alloy from said bath onto said second cathode.

2. An electrodeposition process as defined in claim 1 wherein the higher valency salt is titanium tetrachloride which is reduced to produce at least titanium dichloride and titanium trichloride.

3. An electrodeposition process as defined in claim 1 wherein removing the lower valency salt from the cathode is accomplished by mechanically scraping the cathode surfaces.

4. An electrodeposition process as defined in claim 1 wherein said electrolytic bath is continuously stirred.

5. An electrodeposition process as defined in claim 1 wherein said metal to be deposited is titanium.

6. An electrodeposition process as defined in claim 1 wherein said alloy to be deposited is a titanium alloy.

7. An electrodeposition process as defined in claim 1 wherein said fused salt electrolytic bath includes at least salts of Ba, Na, Mg, K and Ca.

8. An electrodeposition process as defined in claim 7 wherein said fused salt electrolytic bath includes a salt of Ti.

9. An electrodeposition process as defined in claim 1 wherein step (d) occurs at a temperature higher than 500° C.

10. An electrodeposition process as defined in claim 1 wherein step (d) occurs in the presence of the desired metal or alloy in said bath.

11. An electrodeposition process as defined in claim 1 wherein a first electrolytic cell and a second electrolytic cell are respectively employed to conduct steps (d) and (f).

12. A method of electrodepositing titanium or a titanium metal comprising the steps of:

(a) preparing a fused alkali and alkaline earth metal chloride salt electrolytic bath containing at least one lower valency titanium chloride salt therein, said bath containing therein at least operational first and second cathode electrodes and at least one operational anode electrode;

(b) adding titanium tetrachloride to said bath;

(c) reducing titanium tetrachloride into a lower valency titanium salt on said first cathode and dispersing said lower valency salt within said bath; and (d) electrodepositing titanium or a titanium alloy as a substantially homogeneous smooth deposit from said bath on said second cathode.

* * * * *